United States Patent [19]

Slator

[11] Patent Number: 4,869,137

[45] Date of Patent: Sep. 26, 1989

[54] JAWS FOR POWER TONGS AND BUCKING UNITS

[76] Inventor: Damon T. Slator, 4629 Sugar Hill, Houston, Tex. 77056

[21] Appl. No.: 183,670

[22] Filed: Apr. 19, 1988

Related U.S. Application Data

[63] Continuation-in-part of Ser. No. 36,592, Apr. 10, 1987, abandoned.

[51] Int. Cl.[4] ..... B25B 17/00

[52] U.S. Cl. ..... 81/57.18; 81/57.2; 81/57.14; 81/421

[58] Field of Search ..... 81/57.11, 57.14, 57.21, 81/57.2, 57.3, 57.33–57.35, 421–424, 424.5, 186; 269/261–262, 264–268, 254 R, 259, 275, 277, 282, 270–271, 283–284; 403/361, 362

[56] References Cited

U.S. PATENT DOCUMENTS

| | | |
|---|---|---|
| Re. 31,699 | 10/1984 | Eckel . |
| Re. 31,993 | 10/1985 | Wesch, Jr. . |
| 1,811,666 | 12/1929 | Foster . |
| 2,668,689 | 2/1954 | Cormany . |
| 3,589,742 | 6/1971 | Flick . |
| 3,599,960 | 8/1971 | Phillips . |
| 3,776,320 | 12/1973 | Brown . |
| 3,858,468 | 1/1975 | Pasbrig . |
| 4,077,250 | 3/1978 | Wesch . |
| 4,084,453 | 4/1978 | Eckel . |
| 4,089,240 | 5/1978 | Eckel . |
| 4,215,602 | 8/1980 | Carstensen . |
| 4,250,773 | 2/1981 | Haynes . |
| 4,276,771 | 7/1981 | Wesch, Jr. . |
| 4,281,535 | 8/1981 | Wesch, Jr. . |
| 4,334,444 | 6/1982 | Carstensen . |
| 4,350,062 | 9/1982 | Farr . |
| 4,372,026 | 2/1983 | Mosing . |
| 4,401,000 | 8/1983 | Kinzbach . |
| 4,593,584 | 6/1986 | Neves . |
| 4,649,777 | 3/1987 | Buck . |
| 4,709,599 | 12/1987 | Buck . |

FOREIGN PATENT DOCUMENTS

| | | |
|---|---|---|
| 2235285 | 7/1971 | Fed. Rep. of Germany . |

*Primary Examiner*—Debra Meislin

*Attorney, Agent, or Firm*—Pravel, Gambrell, Hewitt, Kimball & Krieger

[57] ABSTRACT

The invention relates to an improved jaw construction for power tongs and bucking units wherein the jaws include a pair of gripping pads which are mounted to the jaws with a resilient insert so that loads applied through the jaw to the pipe are distributed over the gripping pads to minimize scoring the pipe or deformation thereof.

12 Claims, 11 Drawing Sheets

JAWS FOR POWER TONGS AND BUCKING UNITS

This application is a continuation-in-part of U.S. patent application Ser. No. 036,592, filed Apr. 10, 1987, now abandoned.

FIELD OF THE INVENTION

This invention relates to the field of power tongs and bucking units.

BACKGROUND OF THE INVENTION

This invention pertains to devices employed for making up threaded joints on tubular goods (tubing and casing) used in oil and gas wells. Joint integrity is of utmost importance since a leak in any one joint of high pressure tubing can necessitate killing the well and removing and replacing the tubing string. Such removal and replacement is expensive. In other situations leakage in tubing joints can cause loss of the entire well.

Power tools have been in general use for a number of years for making up threaded tubular goods. The term bucking unit is generally applied to makeup machines used to install couplings on pipe usually in a pipe mill or threading facility. These units are used to make up and buck up couplings on pipe lying in the horizontal position. The bucking unit assembly includes a drive unit which imparts a rotary torque to a coupling and the backup unit which holds the end of the pipe in position and provides the necessary backup torque. Typical of such units is the Model 811 bucking unit manufactured by Bowen Tools, Inc., Peck-o-matic Division in Houston. Chapter 6, especially pages 6–7 of the 1982 catalog disclose the major components of the bucking unit.

The term "power tongs" is generally applied to makeup machines used to connect joints or lengths of pipe together to form continuous strings as successive joints are added and the assembled pipe is lowered into the well. Rotary power for making up the threaded connection is provided by the power tongs. A backup device is normally mounted below the power tongs to hold the adjacent pipe stationary as the power tongs are actuated.

Both the drive unit and the backup unit employ gripping devices or jaws which move inwardly to contact the relatively smooth surface of the pipe or coupling and impart sufficient forces thereto to transmit torque from the driving means to the members being threadedly joined.

Various mechanisms have been used to actuate the jaws. For example, in U.S. Reissue Pat. No. 31,699, sliding heads 32 and **32*a* hold jaws 92. The heads 32 are guided by channels 110. The heads are mounted with a roller 114 which interacts with a cam ring 90 such that rotation of the cam ring results in inward displacement of the rollers 114 out of depressions 180 and 180a toward the pipe to be gripped. In U.S. Pat. No. 4,084,453 link members 134 and 136 are pivotally mounted to a pin on a drag plate. The forward dies 144 and 146 are radially displaced when rollers 152 and 154** are displaced due to the rotation of the cam ring.

U.S. Pat. No. 4,089,240 discloses a similar design which uses three dies on each member 134. Still other similar designs are disclosed in U.S. Pat. No. 4,350,062. U.S. Pat. No. 4,334,444 shows actuation of die carriers by displacement of a roller mounted to the die carriers upon rotation of a cam ring. A pair of dies having short circumferential dimensions are used with each jaw block. The design in U.S. Pat. No. 4,215,602 is very similar. Dies having longer arcuate lengths have been used as illustrated in literature published by South Coast Tong and Rental, Inc. of Lafayette, La. and sold under the SUREGRIP trademark. A pair of such dies are claimed to grip around 220° of a pipe. The manufacturer claims that such design reduces the possibility of crushing in high torque situations which are encountered in working over problem wells. This design employs rows of parallel teeth. Claims are further made in sales literature that the jaws of this design effectively distribute the load over a much larger area of the tubing thereby assuring less penetration into the pipe. Experience has shown that such load distribution characteristics in high torque applications have not been realized.

U.S. Pat. No. 4,593,584 also illustrates extended length dies which claim to grip greater than 230° around the pipe. U.S. Pat. No. 4,372,026 discloses a plurality of pinion gears connected to cam elements which move into and out of contact with the pipe upon rotation of a ring gear. The cam surfaces engage the pipe as opposed to the jaw designs of the other patents discussed above.

U.S. Pat. No. 4,334,444 shows the general arrangement of a power tong which employs a rotatable cam ring or base or bowl and cam dogs and dies. As the cam ring is rotated, the dies are urged inward by the cam surface until the dies contact the pipe and bite into the surface to permit the transmission of tangential torsional forces through friction. The contact between the dies and the pipe is essentially a line contact. In essence, each die makes an initial contact along a line parallel to the longitudinal axis of the pipe. The bulk of the initial forces transmitted from the jaw to the pipe occur along this line hence the term line contact. In practice, due to the fact that the pipe deflects under the heavy forces involved and due to the fact that the jaw teeth penetrate into the surface of the pipe, the contact area is spread to a limited extent and forms a narrow band of contact.

In any case, localized gouging of the pipe is undesirable as is permanent deformation of the pipe.

Applying the principles of mechanics and strength of materials, it can be shown that the normal forces applied to the pipe at the points where the die contacts the pipe are quite large with the normal load on the leading die in the direction of rotation, being considerably larger than the normal load on the trailing die. The result is that the pipe is deformed considerably during the process of making up a joint and the jaw teeth can cause severe penetration of the pipe surface. Deformation during makeup and the residual permanent deformation adversely effects the integrity of the joint.

The advantage of the camming design disclosed in U.S. Pat. No. 4,334,444 using a pair of opposed jaw blocks is that one jaw size can accommodate a range of pipe sizes. The range can be further increased by inserting thicker dies in the same jaw blocks.

The wrap around die design illustrated in U.S. Pat. No. 4,593,584 reduces the deflection of the pipe in an apparent attempt to spread the load over a larger area of the pipe circumference. However, there still exists a large variation from the toe or leading edge of the die to the heel or trailing edge of the die. The tooth penetration at the leading edge of the die is somewhat reduced; however, the forces can still be sufficient to cause scoring or the pipe wall and in some instances permanent deformation.

Reissue Pat. No. 31,699 illustrates a guided jaw. Jaws are placed in slots in an effort to equalize the forces over the arc of contact. However, new frictional forces evolve between the jaw block and the slots requiring additional applied forces. Clearance necessary for freedom of movement of the jaw block within the guides permits the jaw block to move sufficiently to cause the dies at the leading edge to bite deeply into the pipe surface. This phenomenon is true whether dies having a small circumferential length as shown in Reissue Pat. No. 31,699 are used or whether the wrap around type dies such as those shown in U.S. Pat. No. 4,593,584 are used.

U.S. Pat. No. 4,350,062 illustrates an offset cam dog design.

U.S. Pat. No. 4,372,026 illustrates a gear actuated design. A ring gear is rotated by means of external gear drive or chain drive. As the internal gear rotates it acts upon the gear segments of the jaw mechanism causing the jaw blocks to rotate from the retracted position to engage the pipe. As soon as the die makes contact with the pipe, the friction forces cause the jaw block to wedge between the pipe and the ring gear. Thereafter the ring gear, the jaws and the pipe rotate together as a unit. Normally five jaws are used for smaller pipe and up to ten for larger diameter pipes. The normal loads on the pipe are all essentially equal, hence there is less distortion of the pipe as compared to the cam dog designs described above and less damage to the pipe surface.

An object of this invention is to provide a jaw block and die combination design to provide uniform distribution of forces along the face of the dies to minimize biting into the pipe by the die and deflection of the pipe under heavy loads.

SUMMARY OF THE INVENTION

The invention relates to an improved jaw design for power tongs and bucking units wherein the jaws include a pair of gripping pads which are mounted to the jaws with a resilient insert so that loads applied through the jaw to the pipe are distributed over the gripping pads to minimize scoring or deformation thereof.

DESCRIPTION OF THE PREFERRED EMBODIMENT

Figure 1:
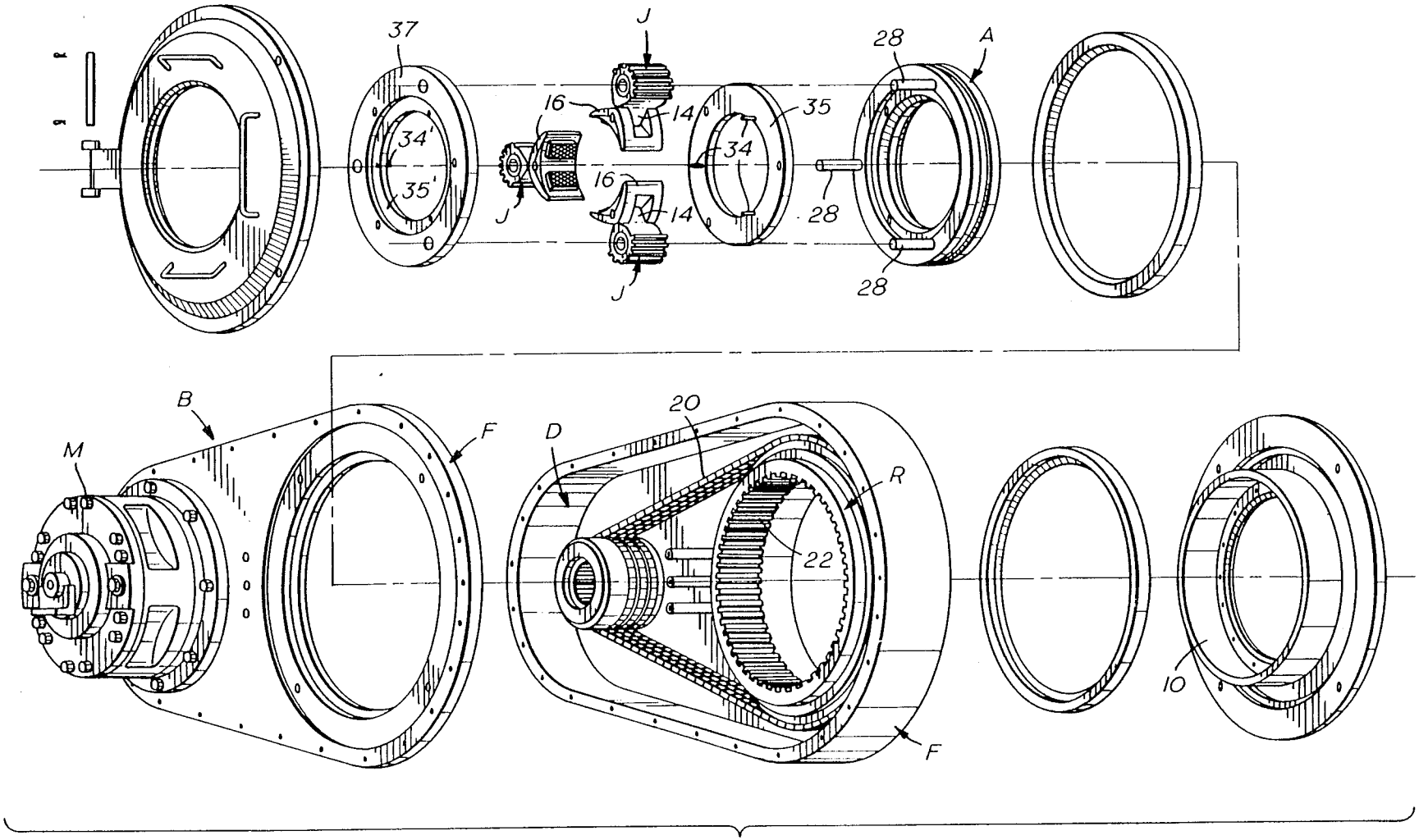
FIG. 1 is an exploded view of a bucking unit showing gear driven jaws.
Figure 2:
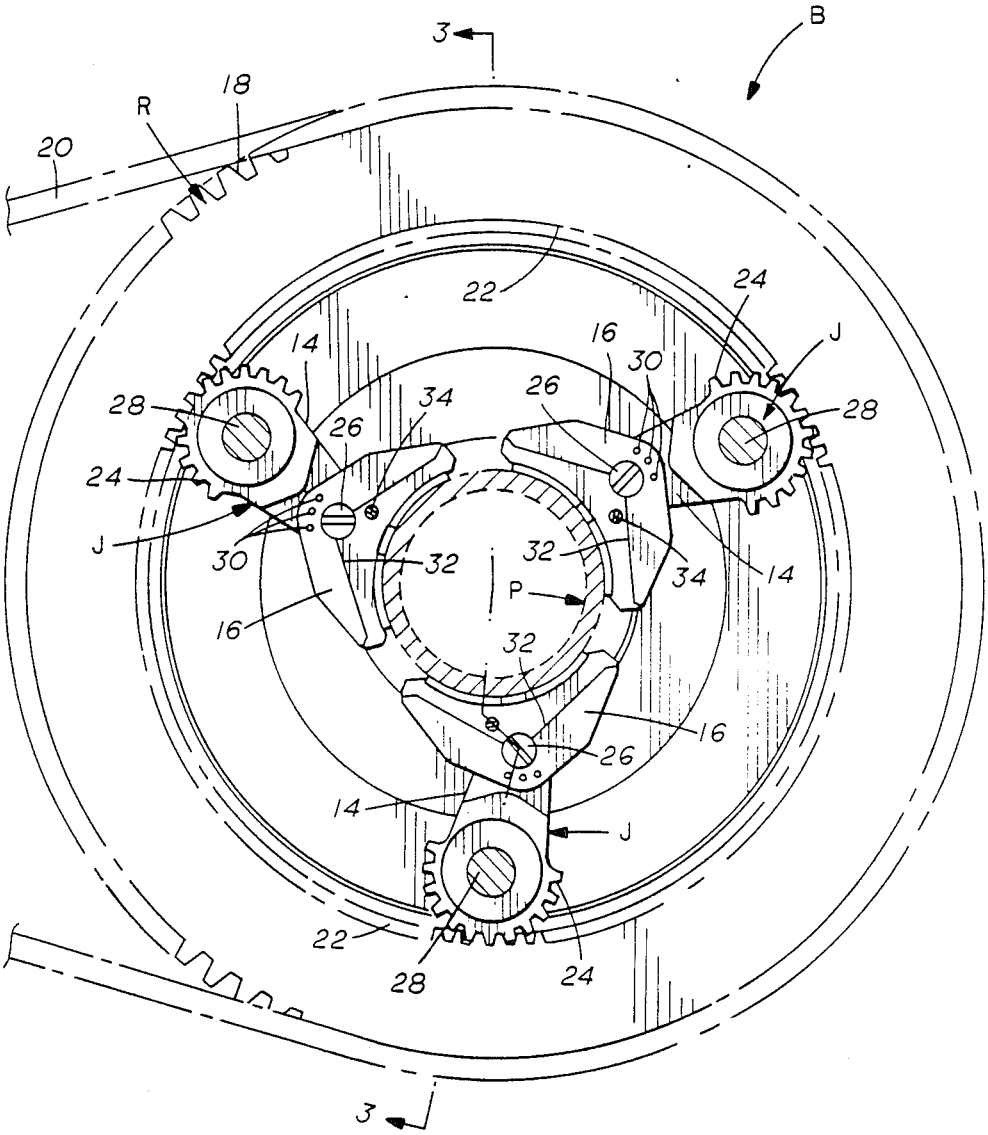
FIG. 2 illustrates a bucking unit with gear driven jaws wherein the gripping pads on each jaw are in contact with the pipe.
Figure 3:
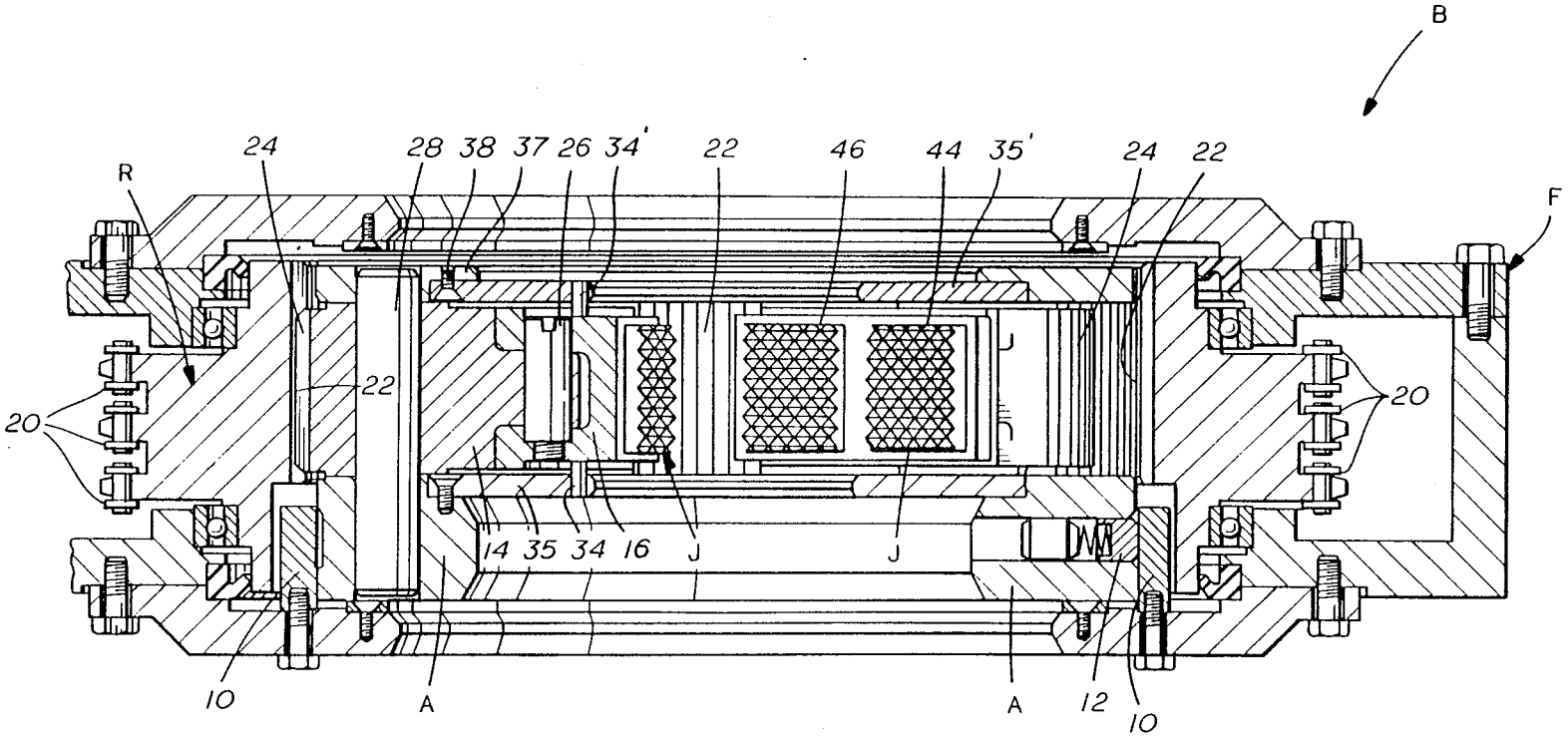
FIG. 3 is section through line 3—3 of FIG. 2.

Referring to FIGS. 1–3, a bucking unit B is illustrated showing the major components. Although a bucking unit is illustrated similar features can be employed in a power tong. The bucking unit B has a frame F. A drive D is mounted within frame F to transmit forces imparted by motor or drive means M to an actuating member or ring gear R. Drag ring A is nested within bushing 10. As seen in FIG. 3, drag ring A has a plurality of spring loaded resistance buttons 12 to maintain the initial position of drag ring A as drive D rotates ring gear R. The assembly of drag ring A also supports a plurality of reversing pins 34.

Figure 4:
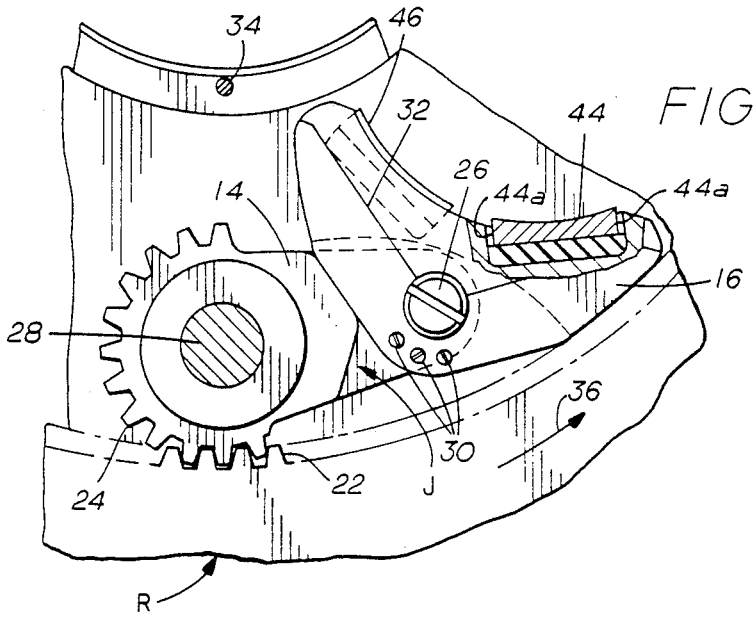
FIG. 4 illustrates a jaw in one extreme position.
Figure 5:
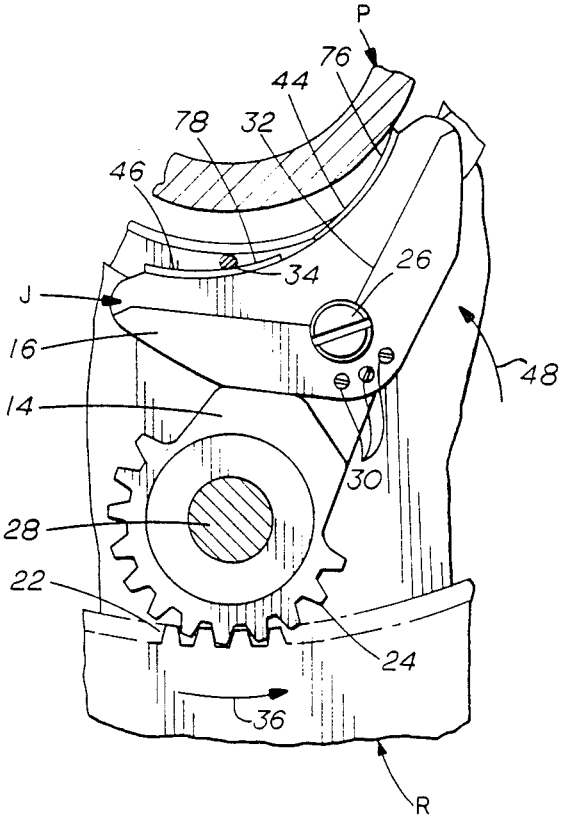
FIG. 5 illustrates the jaw after translation toward a pipe and showing initial contact of the gripping pad with the pipe.
Figure 6:
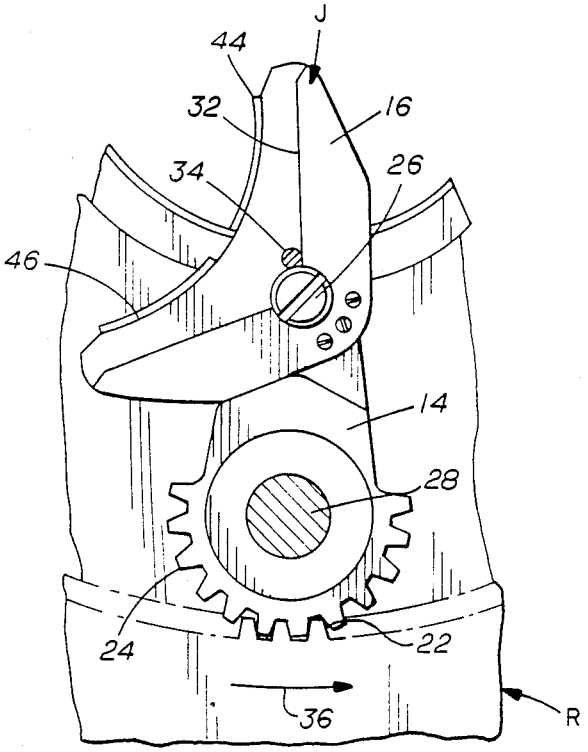
FIG. 6 illustrates the operation of a reversing pin in first contact with a jaw in the absence of a pipe in the power tong or bucking unit.
Figure 7:
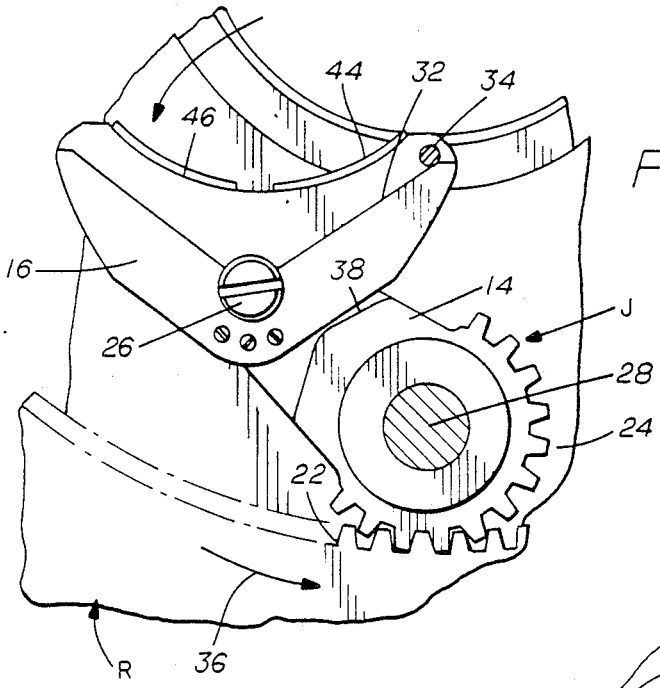
FIG. 7 illustrates the reversing movement of the jaw when the reversing pin is in its last phase of contact with the shoulder on the jaw.
Figure 8:
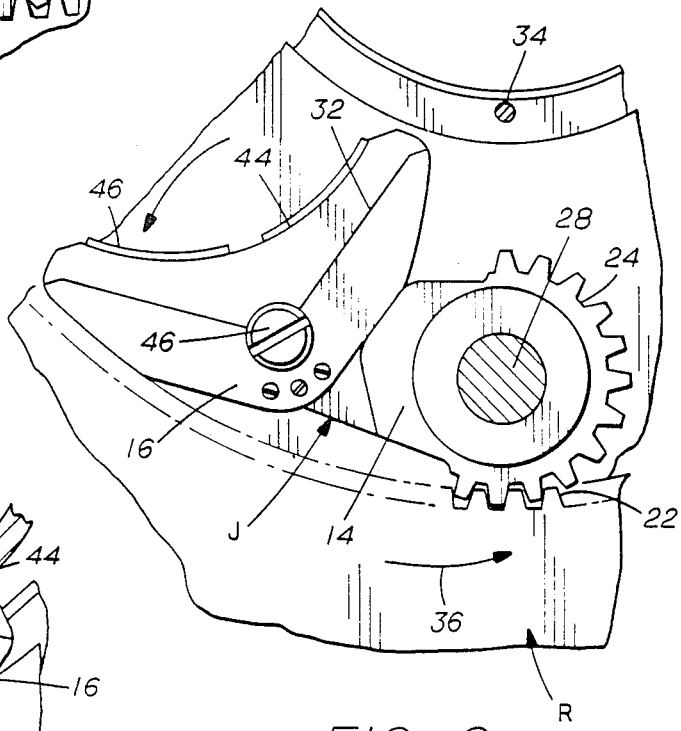
FIG. 8 indicates the opposite extreme position from that shown in FIG. 4.
Figure 9:
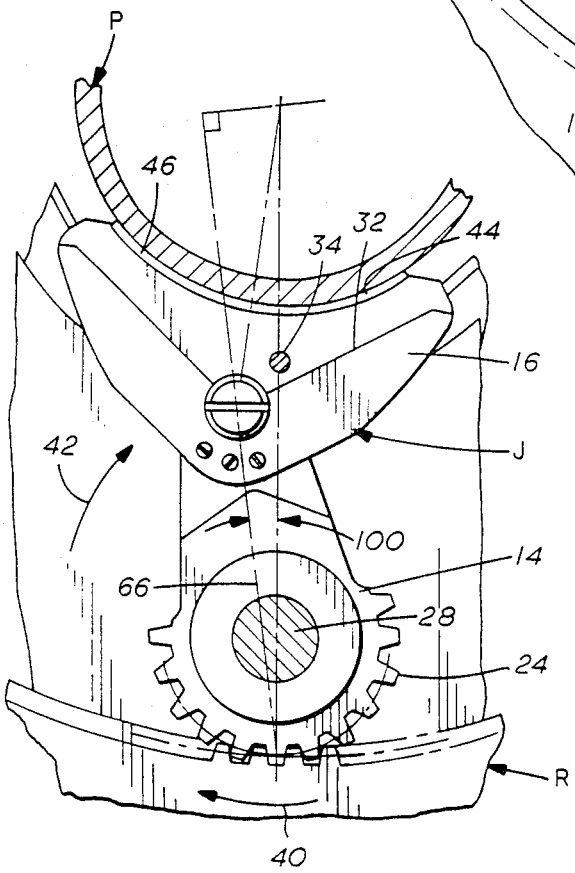
FIG. 9 illustrates gripping pads in contact with the pipe and the direction of forces applied to the pipe.

As seen in FIGS. 1 and 2, the bucking unit B employs three jaw assemblies J. As seen in FIG. 2, each jaw assembly J includes a link 14 and gripping member 16. Ring R has external teeth 18 which engage chains 20 to transmit rotational forces from motor M to ring gear R. Ring gear R also has internal teeth 22 which engage teeth 24 on each jaw assembly J. Teeth 24 are disposed on link 14. Gripping member 16 is pivotally mounted to link 14 by pivot connection or pin 26. Link 14 is pivotally mounted to drag ring A by virtue of pin 28. A plurality of motion retarding pins 30 are mounted to each gripping member 16 and extend into sliding contact with link 14 to resist the pivoting motion of gripping member 16 about pin 26. Each jaw assembly J further comprises a reversing shoulder 32. Reversing shoulder 32 is designed to interact with reversing pin 34 in the absence of a pipe P extending through the bucking unit B. The interaction between the reversing shoulder 32 and reversing pin 34 is illustrated in FIGS. 4 and 6–8. As shown in FIG. 4, the jaw assembly J is in one extreme position with gripping member 16 at rest against teeth 22 of ring gear R. Counterclockwise motion of ring gear R in the direction of arrow 36 results in counterclockwise rotation of link 14 due in part to the fact that drag ring A is initially held in position via the interaction of spring loaded resistance buttons 12 against bushing 10 (FIG. 3). The frictional force between buttons 12 and bushing 10 fixes drag ring A sufficiently long enough to initiate counterclockwise rotation of link 14. In the absence of a pipe P disposed within the bucking unit B, as shown in FIG. 6, contact is made between reversing shoulder 32 and reversing pin 34. Further rotation of ring gear R in the direction of arrow 36, results in clockwise rotation of gripping member 16 about pin 26. Further counterclockwise movement of ring gear R in the direction of arrow 36 completes the clockwise rotation of gripping member 16 about pin 26. As shown in FIG. 7, the clockwise rotation of gripping member 16 relative to link 14 is complete when gripping member 16 engages a shoulder or travel stop 38 on link 14. FIG. 8 shows the final position of jaw assembly J upon further movement of ring gear R in the direction of arrow 36. Consequently, the direction of rotation of ring gear R may be reversed by employment of the drive means D whereupon gripping member 16 will be driven toward a pipe P within the bucking unit B for application of a clockwise torque on pipe P. This is illustrated in FIG. 9 which shows ring gear R driven in a clockwise direction (arrow 40). Link 14 is driven clockwise in the direction of arrow 42 until contact is made between the pipe P and gripping pads 44 and 46. FIG. 5 shows gripping member 16 approaching the pipe P from the opposite direction as that shown in FIG. 9. In FIG. 5, ring gear R is rotated in a counterclockwise direction as shown by arrow 36 which in turn rotates link 14 counterclockwise in the direction of arrow 48. Gripping pad 44 makes the initial contact with pipe P. Upon further rotation, gripping member 16 pivots about pin 26 until gripping pads 44 and 46 of each jaw assembly J come into flush contact with pipe P at approximately the same instant and gripping faces 76 and 78 thereof come into frictional engagement with the surface of the pipe P. Thereupon the jaw assemblies J become wedged between the pipe P and the ring gear R as shown in FIG. 2. Thereafter, further rotation of the ring gear R causes the ring gear R, the jaw assemblies J, and the pipe P to rotate as a unit, so that the pipe P is rotated by the rotational movement of the ring gear R and the jaw assemblies J.

Figure 10:
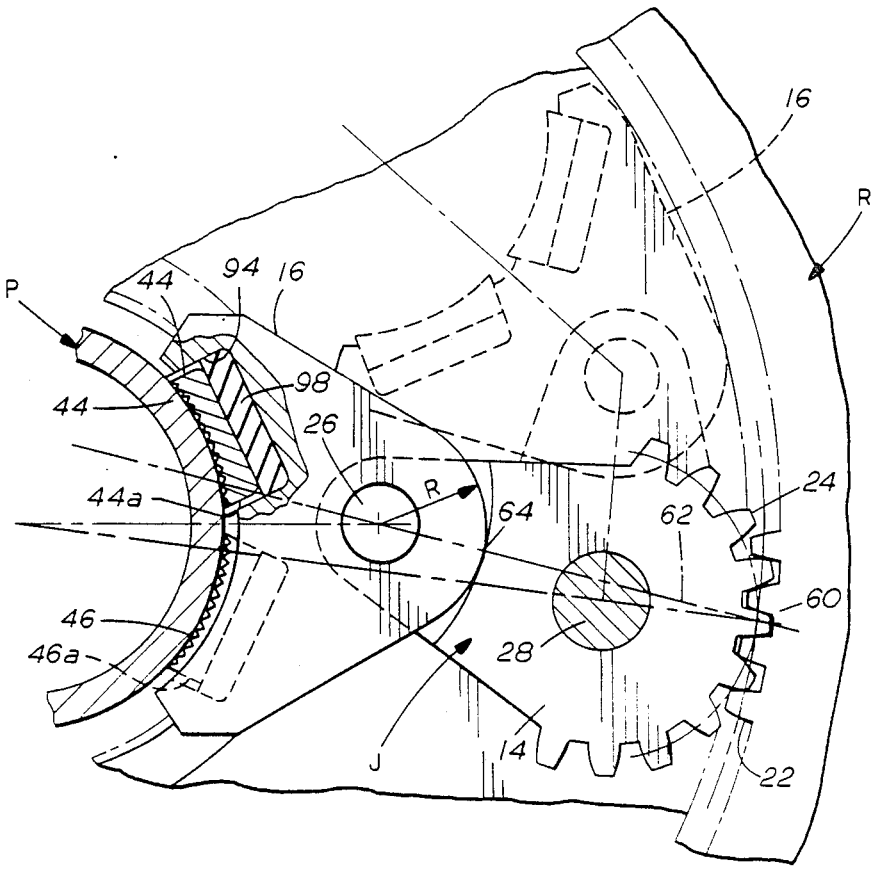
FIG. 10 is an alternate jaw construction wherein forces are transmitted from a link through the jaw by virtue of shoulders on the link.
Figure 11:
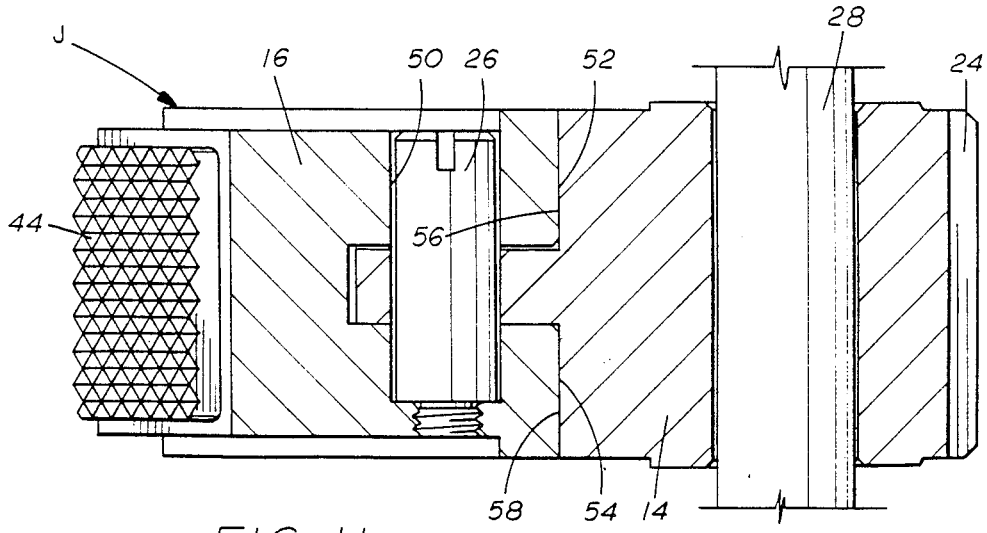
FIG. 11 is a sectional view taken along lines 11—11 of FIG. 10.

An alternative jaw assembly J is illustrated in FIGS. 10 and 11. In this embodiment, the jaw assembly J comprises a link 14 and a gripping member 16. Link 14 is pivotally mounted to drag ring A (not shown) via pin 28. Gripping member 16 is pivotally mounted to link 14 via pin 26. As shown in FIG. 11, there is clearance 50 between pin 26 and gripping member 16. Upon engagement of gripping pads 44 and 46 with the pipe P, arcuate surfaces 52 and 54 on gripping member 16 engage arcuate shoulders 56 and 58, respectively. Arcuate shoulders 56 and 58 are disposed on link 14. Accordingly, torsional forces are imparted on the pipe P from ring gear R along the line extending from the point of tangency 60 along line of action 62. Line of action 62 extends from the point of tangency 60 through point 64 which is the point of contact between arcuate surfaces 52 and 54 with arcuate shoulders 56 and 58, respectively. As a result of such contact, the forces are transmitted along line of action 62 from ring gear R through link 14 through gripping member 16 and on to pipe P via contact between pipe P and gripping pads 44 and 46. The clearance 50 between pin 26 and gripping member 16 allows the forces to be transmitted from ring gear R through link 14 to gripping member 16 while minimizing the stresses on pin 26 as a result of the transfer of forces from link 14 to gripping member 16 via contact point 64. FIG. 10 also illustrates the position of gripping member 16 in dashed lines abutting ring gear R which is its position as a pipe P is inserted into the bucking unit B. The embodiments shown in FIGS. 10 and 11 is useful for large size pipe where it is desirable to minimize the stresses on pin 26 which would otherwise be in the line of action 66 in the embodiment shown in FIG. 9.

Figure 12:
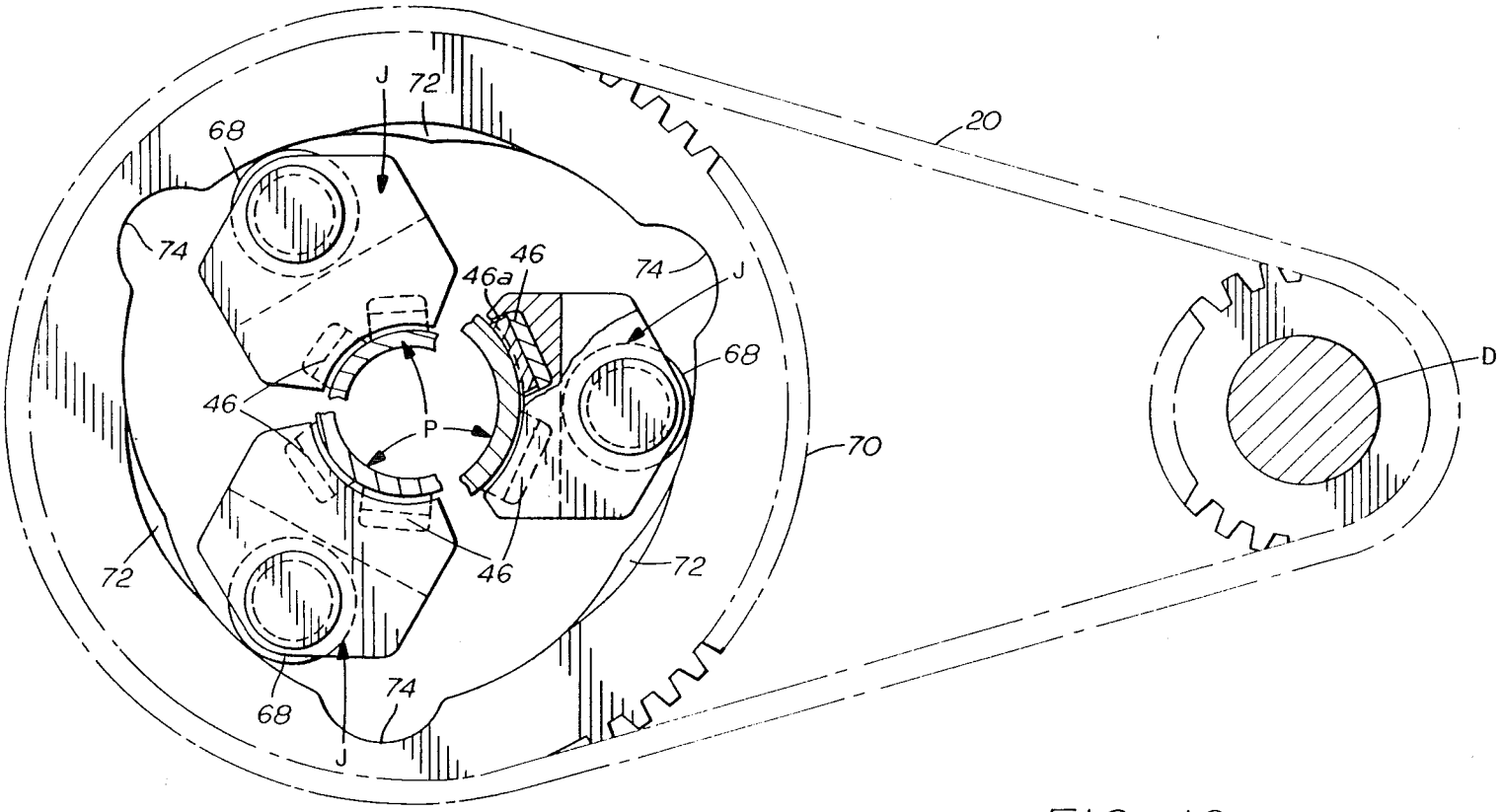
FIG. 12 shows the use of resiliently mounted gripping pads in a cam dog design for a bucking unit or power tong.

FIG. 12 illustrates yet another method of actuating jaw assemblies J. Each jaw assembly is mounted on a roller 68. Drive means D is actuated to turn an actuating member or gear 70. Gear 70 has a plurality of camming surfaces 72 disposed between rounded depressions 74. The support for jaw assemblies J has been deleted for clarity. Rotation of gear 70 displaces rollers 68 from depression 74 and causes movement of rollers 68 along cam surfaces 72, thereby displacing gripping pads 44 and 46 radially inwardly. For illustrative purposes, three different size jaw assemblies are shown in FIG. 12 to indicate that different size pipe P can be inserted in the bucking unit B depending on the size of the jaw assemblies employed. However, for any size pipe being used, all the jaw assemblies are of equal dimensions. As seen in the embodiment of FIG. 12, the jaw assemblies J are unitarily constructed rather than the two-piece construction illustrated in FIGS. 9 and 10.

The following disclosure of the construction and function of the gripping elements shown in FIGS. 13 and 14, and FIGS. 16–18 which are disclosed for use with the cam-actuated version of the jaw assembly J shown generally in FIG. 12 applies also to the link-actuated jaw assembly J of FIGS. 1–11. The gripping member 16 of FIGS. 1–11 corresponds to the gripping member or block 84 in FIGS. 12–18.

Figure 13:
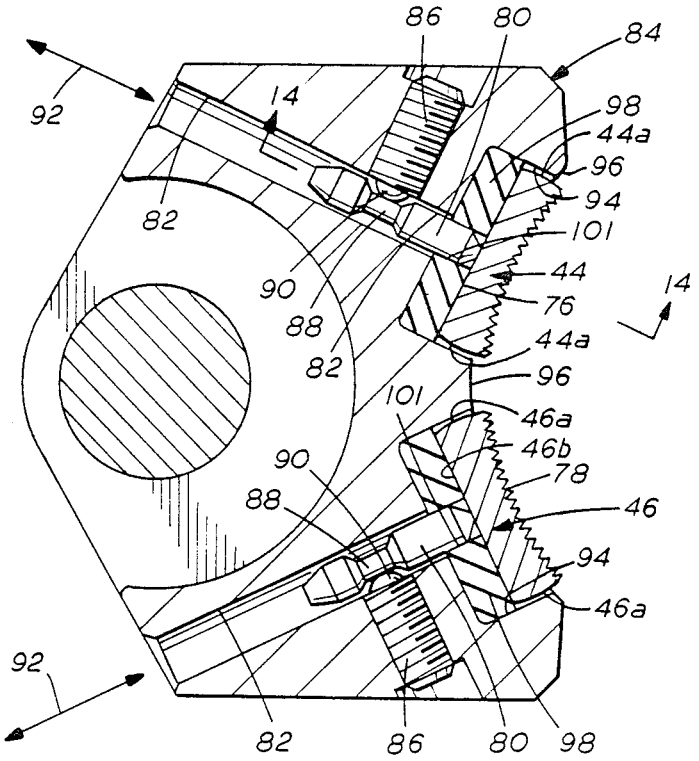
FIG. 13 is a detailed plan view of a jaw block showing the resilient mounting of the gripping pads.
Figure 14:
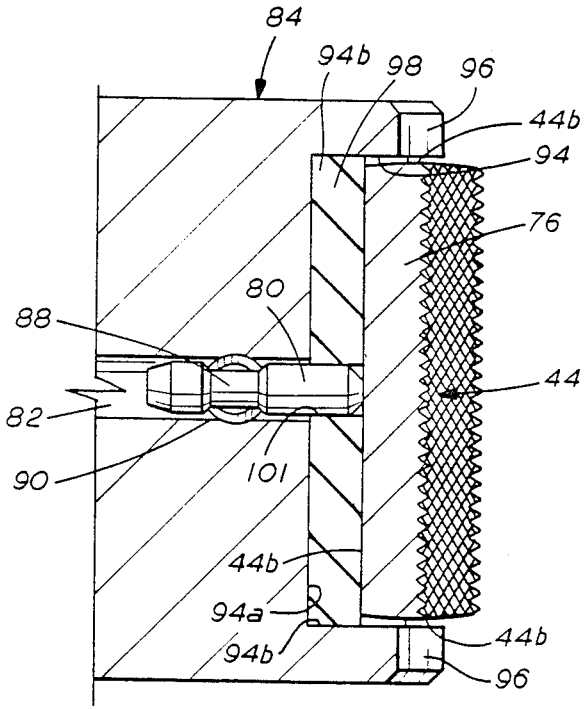
FIG. 14 is a section through lines 14—14 of FIG. 13.

The preferred construction of the gripping pads 44 and 46 and their related structure is illustrated in Figs. 13 and 14. Gripping pads 44 and 46 have a gripping face 76 and 78, respectively. As shown in FIG. 14, gripping face 76, as well as gripping face 78, extend longitudinally parallel to the longitudinal axis of the pipe to be gripped and have an arcuate shape conforming to the pipe outside diameter. Each of the gripping pads 44 and 46 has an extension stem 80 connected to its inner surface by welding or other suitable means. Each stem 80 extends into an annular elongated cavity 82 of the block 84. Each stem 80 is retained within cavity 82 by virtue of a set screw or spring-loaded detent 86. Each stem 80 has a longitudinal depression 88 thereon. A set screw 86 has an engaging section 90 which extends into cavity 82 and into longitudinal depression 88. Thus, gripping pads 44 and 46 are retained within block 84 but may move a limited distance axially in the direction of arrows 92. Also, clearance between the wall of the cavity cavity 82 and stem 80 permits limited movement of gripping pads 44 or 46 in any direction without interference between stem 80 and cavity 82. Any well known spring loaded detents may be used in place of set screws 86 to permit easier replacement of worn gripping pads 44 or 46.

Block 84 has a pair of recesses 94, each of which is adapted to receive one of the gripping pads 44 and 46, and a resilient insert 98. Gripping pads 44 and 46 are formed to generally correspond to the shape of recesses 94 but clearances are provided between the outside of the side edges **44*a* and 46*a* of the gripping pads 44 and 46, respectively, and the inside surfaces of the respective recess 94 such as to permit limited tilting movement of the gripping pads 44 and 46 within the recesses 94. In the drawings, such as FIGS. 4 and 10, the clearance spaces between the side edges 44*a*, 46*a*, and the inside wall surfaces of the recesses 94 are shown larger than in actual practice. For example, such clearance between each side edge 44*a* or 46*a* would usually be about 0.015 inches, with a total clearance from both sides being about 0.030 inches. Preferably, the ends 44a and 46a of gripping pads 44 and 46 are curved slightly as shown in FIG. 13 to facilitate limited tilting of the pads within the recesses 94 without binding. Also, preferably the top and bottom surfaces 44b are also spaced and curved as shown in FIG. 14 to permit some clearance for vertical misalignment and tilting. The curved surfaces 44a shown in FIG. 13 require less clearance between the ends 44a and the side walls of the recess 94 than with straight ends 44a shown in FIGS. 4 and 10 but otherwise, the function is the same. A resilient insert 98 is disposed within each recess 94 and is substantially covered by each gripping pad 44 or 46. Each insert 98 fits in contact with the inside surface 94a, the side surfaces 94b and the inside surfaces 44b or 46b of the pads 44 and 46, so that each insert 98 is confined so as to fill the space in each recess 94 behind each of the gripping pads 44 or 46. The thickness of the gripping pads 44 and 46 and the resilient inserts 98, and the depth of the recesses 94 are dimensioned such that gripping pads 44 and 46 extend out from the arcuate surface 96 of block 84 a distance sufficient to ensure that the surfaces 76 and 78 engage the pipe rather than surface 96 of the block 84. Each insert 98 has an opening 101 therein of substantially the same diameter as the portion of the stem 80 which extends therethrough from gripping pads 44 and 46 into cavity 82**.

Two gripping pads 44 and 46 are disposed in each block 84, preferably equally spaced on each side of the center line of the block. If two jaw assemblies J are used, each pair of gripping members 44 and 46 thereon can contact about 180° of the circumference of pipe P. For three-jaw assemblies J the contact can be about 120° per pair of gripping pads 44 and 46. The gripping faces 76 and 78 can be provided with teeth or other irregular surface as shown in FIG. 14 so that a better grip may be obtained on the pipe. Since tubular sections used in oil and gas operations often contain a coating of grease or other materials on the outside surface, the irregularity or roughened surfaces in gripping faces 76 and 78 improve the gripping engagement of the pipe. However, because of the substantially instantaneous adjustment of the pads 44 and 46 to the pipe P, as will be more fully explained, the contact of the pads 44 and 46 with the pipe P is relatively soft until there is full or substantially full engagement of the pad surfaces 76 and 78 with the pipe P. For that reason, even though there is effective gripping of the pipe P by the pads 44 and 46 for imparting rotation to the pipe P, there is substantially no scoring, indentation or damage to the pipe P.

The line contact problems encountered with designs of the prior art are overcome by the use of the gripping pads 44 and 46 in combination with the resilient inserts 98.

Resilient inserts 98 are made of a solid material, preferably rubber, synthetic rubber, or one of the numerous other compounds referred to in the trade as elastomers, which have the physical characteristics of being essentially incompressible (i.e. essentially no change in volume when pressure is applied to the material) but having limited elasticity and resiliency so that when a deforming force is applied to the material when confined, it deforms in response to the force but it is capable of recovering its shape and size after the force is removed. In essence, the elastomer when confined as used in this invention behaves as a liquid behaves when confined and subjected to pressure. Elastomers are commonly used in the manufacture of 0-rings and other types of seals used for sealing against leakage of fluids under pressure. In such applications, the elastomeric sealing element deforms under pressure with essentially no change in volume to seal by closing any clearance between mating parts to prevent leakage of the fluid. Upon release of pressure, such elastomeric seals return to their original form. As will be more evident hereinafter, that is the way in which the resilient inserts 98 function or perform in this invention.

Although the pads 44 and 46 have been described specifically with respect to FIGS. 13 and 14, it should be noted that the stems 80 and the related set screws 86 may be omitted, as best seen in FIGS. 10 and 11. Also, the ends 44a and 46a of the pads 44 and 46, respectively, as shown in FIG. 10 are straight and spaced with some clearance from the side walls of the recesses 94, the purpose of which will be more fully explained in connection with FIGS. 16–18.

It is necessary to use two gripping pads 44 and 46 instead of one large pad which would grip the same circumferential portion of the pipe. If one continuous pad were used on the gripping member or block 84 (FIG. 13) or a gripping member 16 (FIG. 9), the advantageous features of the resilient inserts of this invention would be lost and a line contact would ensue at the leading edge of the block 84 or gripping member 16. The reason is that the higher load on the leading edge of the gripping pad would deform that end the resilient pad and cause the leading edge to recede within the jaw block 84 (or gripping member 16) until the jaw block 84 itself contacts the pipe.

Figure 15:
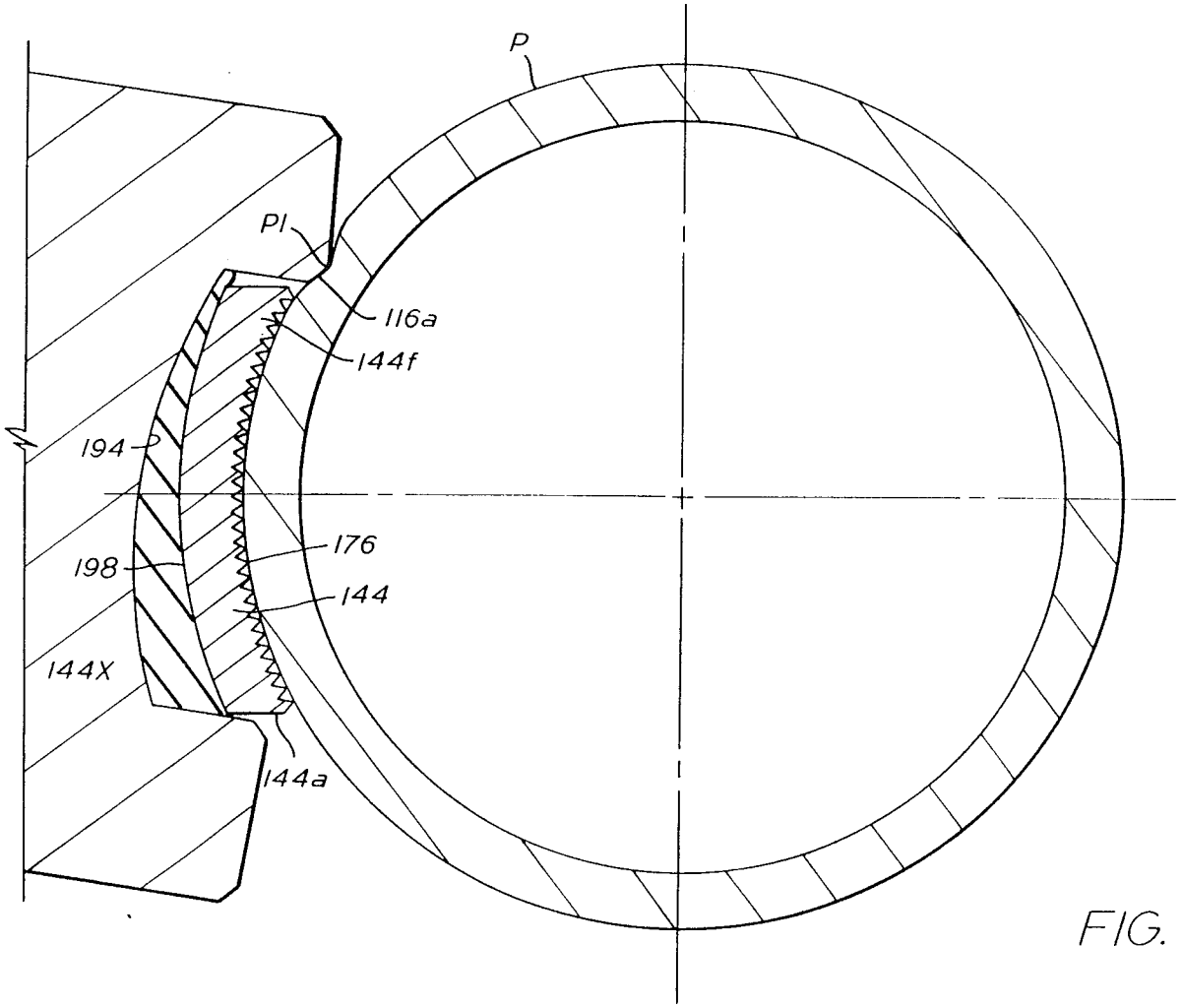
FIG. 15 is a partial sectional view of a single gripping pad, shown in engagement with the pipe.

FIG. 15 is an illustration of the problem encountered when using a single gripping pad 144 instead of the pair of pads 44 and 46. As the jaw block 116 is moved clockwise relative to the pipe P in FIG. 15, the surface 176 frictionally engages the outer surface of the pipe P with the center line of the pad 144 in alignment with the center line C of the pipe P. As the block 116 continues its clockwise movement relative to the jaw pad 144, the insert 198 will deform as shown in FIG. 15 from its normal shape of substantially equal thickness (not shown) so that the leading edge 144f will recede into the recess 194, causing the block portion 116a to be forced into the pipe P with a large line load that may be sufficient to indent, scar, or otherwise damage the pipe P as indicated at P'. Such movement of the pad 144 into the recess 194 will occur whether the outside curvature of the pipe P is the same as the curvature of the gripping surface 176 or is oversize or undersize. Such result is avoided with the present invention by using a pair of gripping pads, as more fully explained hereinafter.

By using two spaced apart gripping pads 44 and 46, the proportions of link 14 and gripping member 16 can be determined so that the line of action 66 (FIG. 9) intersects the outer surface of the pipe P at a point between the center lines of pads 44 and 46. By variation of the proportions of link 14 and gripping member 16, the cam angle as indicated in arrow 100 in FIG. 9 can be varied so that the requisite torque can be applied to pipe P in view of the expected coefficient of friction between the gripping surfaces 76 and 78 and the outer wall of pipe P. Similarly, by varying the proportions of the jaw assemblies J and the curvature of the respective camming surfaces 72 in FIG. 12, the cam angle likewise can be varied. It has been found that the ratio of the resultant normal forces applied by a leading gripping pad divided by the normal resultant forces applied by a trailing gripping pad are preferably in the ratio of 1.5:1 to 2:1. Those skilled in the art will appreciate that decreasing the cam angle will decrease the applied torque to pipe P with an equal load imposed thereon while increasing the cam angle above a certain value will result in relative slippage of contact surfaces 76 and 78 relative to the outer wall of pipe P. Expected coefficients of friction are preferably assumed to be in the range of 0.2 to 0.5.

In the drawings, FIGS. 1–14, and FIGS. 16–18 the inside or back surfaces of the gripping pads 44 and 46, opposite the arcuate gripping surfaces 76 and 78 thereof, have been shown flat and square with the center line of the gripping pad. Such back surfaces could as well be arcuate, preferably concentric with the gripping surface 76 or 78, as illustrated for the back surface 144x in FIG. 15. In any case it is desirable that the thickness of the gripping pads 44 and 46 be made of a metal such as steel which is as thin and flexible as practicable so as to bend easily to conform to the outside surface of the pipe P without breaking under the applied loads.

The unique features of the present invention and the advantages thereof can be more fully explained by reference to FIGS. 16 through 18. In these figures, the gripping pad retaining means have been omitted, and some dimensional variations have been exaggerated for clarity.

As the jaw assemblies J of FIG. 2 or FIG. 12 are urged inwardly toward the pipe P as explained above, the gripping pads 44 and 46 come into contact with the surface of the pipe P and the gripping faces 76 and 78 become frictionally engaged with the surface of the pipe P. Thereafter jaw assemblies J become wedged between the pipe P and the ring gear R (FIG. 2) or the gear 70 (FIG. 12), thereupon the driving gear, the jaw assemblies, and the pipe P rotate as a unit. As will be evident to those skilled in the art, the greater the torque required to turn the pipe, the greater the force which must be applied to the pipe P through each jaw assembly J as explained with reference to FIG. 9 along the line of action 66. This driving force on each jaw assembly J is communicated to the pipe P through gripping pads 44 and 46, which are in frictional engagement with the surface of the pipe.

Figure 16:
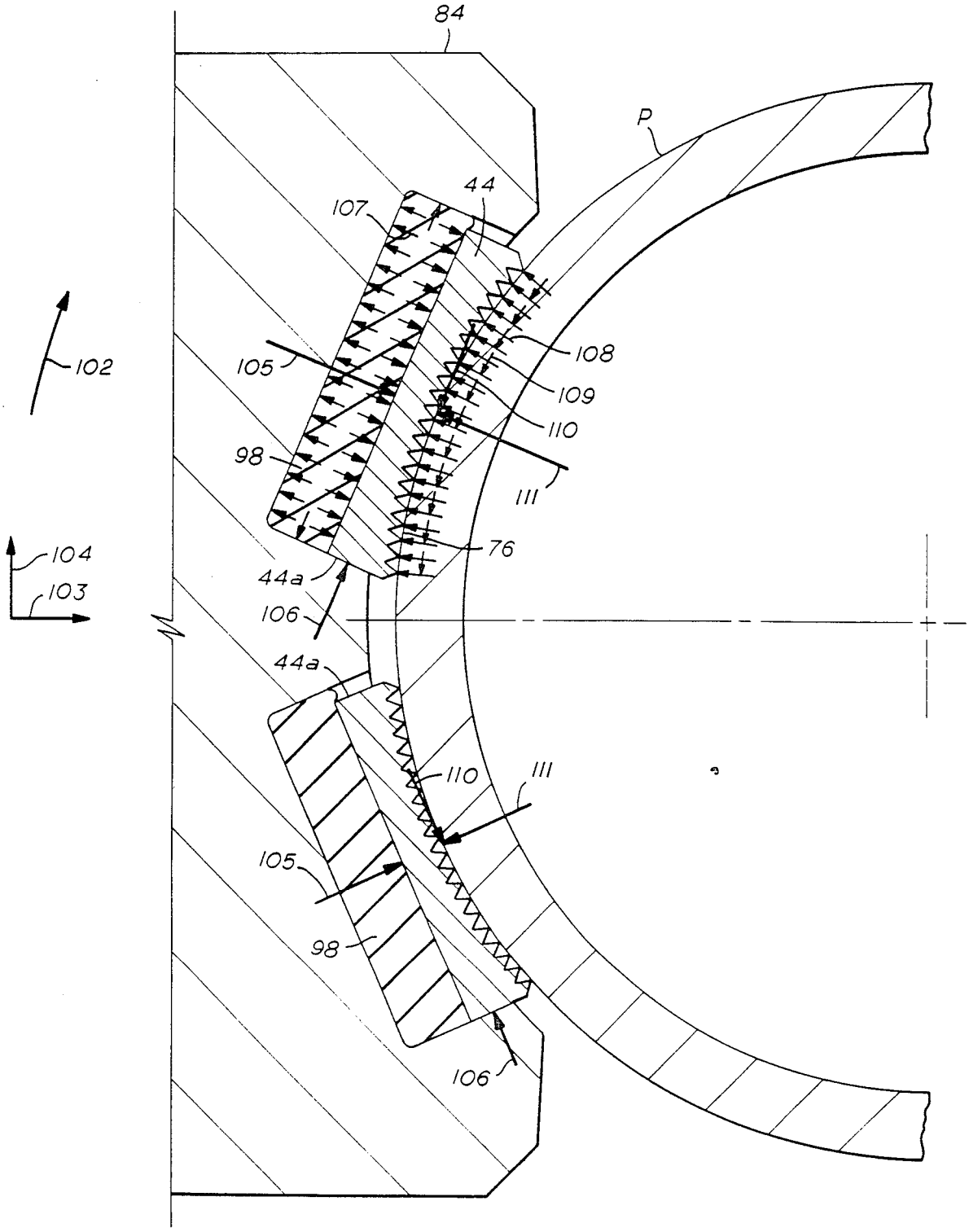
FIG. 16 is a partial sectional view illustrating the distribution of forces acting on one of a pair of the gripping members of the present invention.

FIG. 16 is a partial sectional drawing of a gripping member 16 or block 84 showing the arrangement of gripping pads 44 and 46 with resilient inserts 98 disposed in recesses 94. As torque is applied, as indicated by arrow 102, and resisted by the pipe P, normal forces 103 and tangential forces 104 are generated in proportion to the applied torque. These forces are divided according to the laws of mechanics between the two gripping pads 44 and 46, which are the only portions of each jaw assembly J which are in contact with the pipe P. Such forces on each gripping pad are resolved into a normal force indicated by vector arrow 105 and a tangential force indicated by vector arrow 106. As can be seen in FIG. 16, the normal force 105 is transmitted from the block 84 or gripping member 16 through resilient insert 98. As the jaw assembly is urged toward the pipe P, the gripping pads 44 and 46 are urged to move into recess 94, creating pressure on resilient inserts 98, which are confined in recesses 94 behind gripping pads 44 and 46. Under pressure, resilient inserts 98 behave as a liquid; that is, pressure is transmitted equally throughout the inserts and against the surfaces of recesses 94 and the back of gripping pads 44 and 46. Such pressure is in all directions as indicated by small arrows 107 with respect to insert 98 for pad 44. The same pressure distribution on insert 98 behind pad 46 occurs although the arrows 107 are not shown. Also, the vector forces on pad 46 are less than those on pad 44, as explained above. The product of such internal pressure and the projected area of the back of gripping pads 44 and 46 are equal to the applied normal load 105.

As can be seen, the equally distributed load on the back of each of the gripping pads 44 and 46 is balanced by substantially uniform normal counterforces, represented by small arrows 108 on pad 44, between the gripping face 76 thereof and the surface of the pipe P. The sum of the normal components of such forces 108 is indicated by vector arrow 111. Such uniform normal forces create corresponding substantially uniform tangential frictional forces represented by small arrows 109. For clarity of illustration, the tangential frictional forces 109 are shown inwardly of the external surface of the pipe, but in fact, they occur at such surface. The sum of such uniform frictional forces 109 is represented by vector arrow 110. Tangential force 110 corresponds in opposite sense to the tangential applied load 106. The ratio of the total frictional force 110 and the normal force 111 must be less than the coefficient of friction between the gripping face 76 and the surface of the pipe P; otherwise, slipping will occur. However, in order to minimize the crushing load on the pipe P, the cam angle is adjusted such that the normal force 111 is just sufficient to produce the required friction, thereby substantially eliminating crushing, denting, or other permanent deformation of the pipe P.

In practice, pipe, casing, tubing, and other tubular goods can vary considerably in outside diameter. Thus, it can be seen that in the prior art, if a rigid pipe-gripping die is made to conform to the outside surface of the nominal size pipe, it will not fit properly if the pipe is oversize or undersize. As explained below, this invention is constructed and functions so that uniform gripping of the pipe surface within the normal range of tolerance of pipe diameters is accomplished for each given set of pads 44 and 46.

Figure 17:
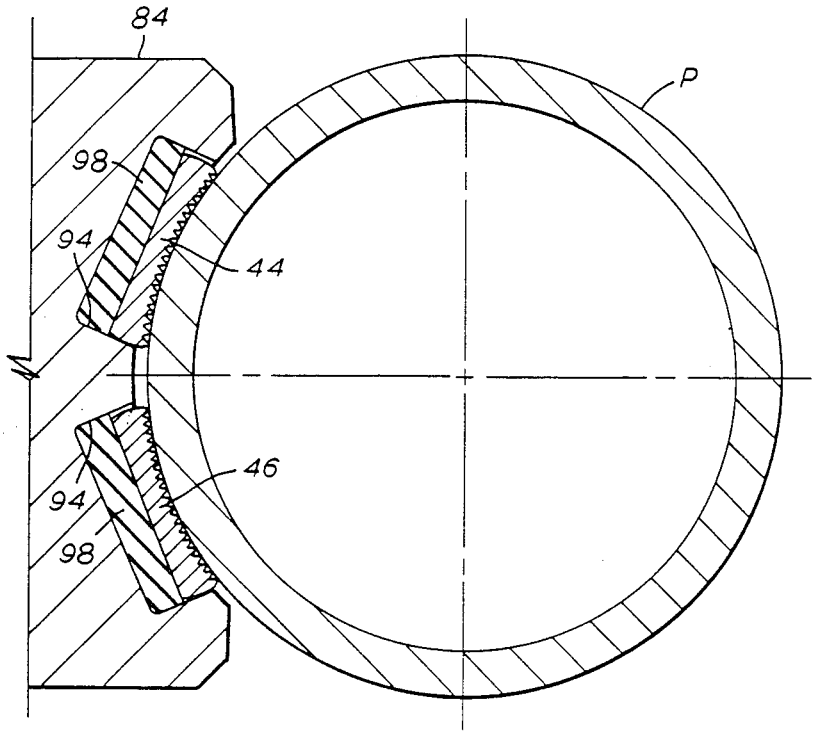
FIG. 17 is a partial sectional view illustrating the deformation of the resilient insert behind each of a pair of gripping pads when the pipe is oversize as compared to the arcuate gripping surfaces of the gripping pads.

FIG. 17 is a partial sectional view of the block 84 or gripping member 16, the gripping pads 44 and 46, and the resilient inserts disposed therein all in gripping and driving contact with pipe P wherein the diameter of pipe P is larger than the nominal size. As jaw member 84 or 16 is urged into forceful contact with pipe P, the first contact between gripping pads 44 and 46 is at the outer edges thereof. However, this initial line contact does not mar the pipe surface nor deform the pipe because as force is applied, the outer edge of the gripping pad displaces the outer portion of the resilient pad, so that the displaced material is deformed or flows toward the inner end of recess 94 thus displacing the inboard end of the gripping pad 44 or 46 outwardly toward the pipe P until such inboard ends contact the pipe. Thereafter, as the applied loads increase, pressure is built up throughout resilient inserts 98 and uniform forces are distributed substantially uniformly along the arcs of contact between the gripping pads 44 and 46 and the surface of the pipe P, as shown in FIG. 16. If one can imagine a closed flexible bag which is filled with liquid and has the same initial shape as the solid insert 98, one can visualize how the solid insert 98 becomes distorted under pressure to the shape shown in FIG. 17. With the insert 98 being of solid material which is elastic or resilient, it will return to its original shape when the pressure is removed.

As noted above, gripping pads 44 and 46 are made to fit with clearance between the side edges 44*a* and 46*a* and the recesses 94 so as to permit limited tilting movement. Also, as noted above, the gripping pads 44 and 46 are preferably made thin and flexible so that they can be bent easily to conform to the outside contour of the pipe P if there is a slight non-conformity in the original curvature of the pads 44 and 46 as compared to the external surface of the pipe P.

Figure 18:
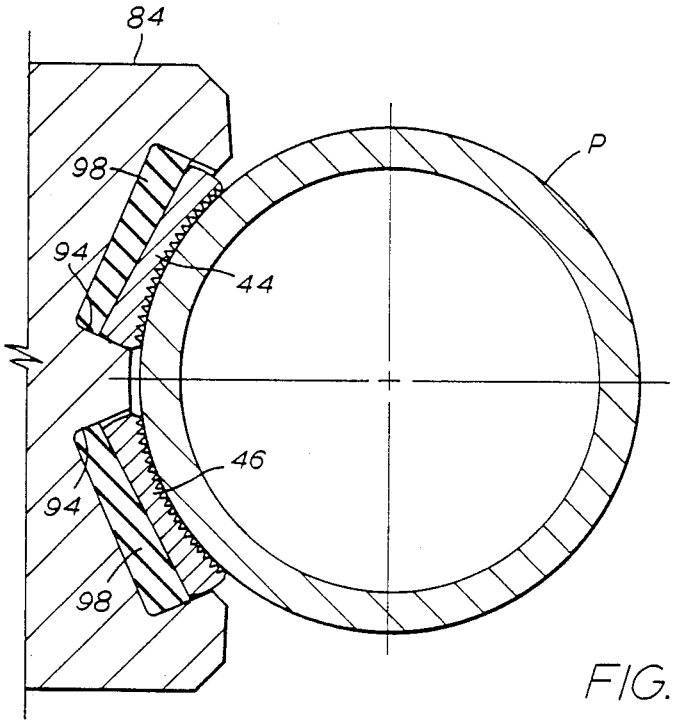
FIG. 18 is a partial sectional view, similar to FIG. 17, but illustrating the opposite deformation of the resilient inserts in a pair of gripping pads when the pipe is undersize as compared to the arcuate gripping surfaces of the gripping pads.

FIG. 18 is similar to FIG. 17, but illustrating the function of the apparatus of the present invention when the outside diameter of the pipe is smaller than the nominal size. It will be seen that the edges of the pads 44 and 46 adjacent to each other have moved outwardly to deform the rubber inserts 98 in an opposite manner to that which occurred in the FIG. 17 situation.

The foregoing disclosure and description of the invention are illustrative and explanatory thereof, and various changes in the size, shape and materials, as well as in the details of the illustrated construction may be made without departing from the spirit of th invention.

I claim:

1. An improvement to a jaw apparatus for use in a machine to apply or resist torque applied to a pipe to thread or unthread one segment of pipe relative to an adjacent segment, the improvement comprising:

a plurality of jaws;

pivot means mounting each of said jaws for pivotal movement relative to the pipe to be gripped;

a pair of gripping pads mounted to each of said jaws, each gripping pad having an outer gripping face formed to substantially conform with and adapted to engage the outside diameter of the pipe to be torqued;

each of said gripping pads also having an inner surface;

each of said jaws having a pair of recesses for receiving said pair of gripping pads, each of said recessed having a recess wall and adapted to receive one of said gripping pads with its said inner surface disposed therein; and an elastically deformable elastomer insert means disposed within and filling each of said recesses inwardly of each of said gripping pads for providing a substantially even distribution of forces, equivalent to force distribution in a confined hydraulic medium, along the entire length of each of said gripping pads upon an uneven force being applied on each of said gripping pads when there is contact between said gripping pads and the pipe;

whereupon the pressure applied by each of said gripping pads is resultantly substantially uniform over said outer gripping face of each of said gripping pads.

2. The improvement of claim 1 wherein:

each of said jaws has an elongated cavity in communication with each said recess;

each of said gripping pads further comprises an extension stem disposed in said cavity;

and retaining means for retaining said stem in said cavity while permitting a limited degree of movement of said stem in a direction parallel to the longitudinal axis of said cavity.

3. The improvement of claim 2 wherein said retaining means further comprises:

each said stem having a longitudinal depression thereon; and a plurality of adjustable retaining members each of which is mounted on an intersecting axis to one of said cavities and which extends into a corresponding depression on the stem disposed therein.

4. The improvement of claim 1 wherein:

each of said insert means in a recess substantially conforms to the space in said recess inwardly of the gripping pad in said recess; and each of said gripping pads extends outwardly beyond said recess in which it is disposed for engagement with the pipe.

5. A machine for applying or resisting a turning force to a pipe comprising:

a frame;

an actuating member mounted to said frame;

drive means connected to said frame for selective movement of said actuating member;

a drag ring supported by said frame;

a plurality of jaws pivotally mounted to said drag ring and operably connected to said actuating member;

means mounting said actuating member for permitting relative movement of said actuating member with respect to said drag ring to cause said jaws to pivot and move toward and into contact with the pipe;

each jaw further comprising:

a pair of gripping pads mounted to each of the jaws, each of said gripping pads having a gripping face formed to substantially conform with and adapted to the outside diameter of the pipe to be torqued;

each of said gripping pads also having an inner surface;

each of said jaws having a pair of recesses for receiving said pair of gripping pads, each of said recesses having a recess wall and adapted to receive one of said gripping pads with its said inner surface disposed therein; and an elastically deformable elastomer insert means disposed within and filling each of said recesses inwardly of each of said gripping pads for providing a substantially even distribution of forces, equivalent to force distribution in a confined hydraulic medium, along the entire length of each of said gripping pads upon an uneven force being applied on each of said gripping pads when there is contact between said gripping pads and the pipe;

whereupon the pressure applied by each of said gripping pads is resultantly substantially uniform over said outer gripping face of each of said gripping pads.

6. The machine of claim 5 wherein:

each of said jaws has an elongated cavity in communication with each of said recesses;

each of said gripping pads having an extension stem disposed in the cavity in communication therewith;

and means for retaining said stem in said cavity while permitting a limited degree of movement of said stem in a direction parallel to the longitudinal axis of said cavity.

7. The improvement of claim 6 wherein said retaining means further comprise:

each of said stems having a longitudinal depression thereon; and a plurality of adjustable retaining members each of which is mounted on an intersecting axis to one of said cavities and which extends into a corresponding depression on a stem disposed therein.

8. The machine of claim 5 wherein:

each of said insert means disposed in a recess substantially conforms to the space in said recess inwardly of the gripping pad in said recess;

each of said gripping pads extending outwardly beyond each of said recesses for engagement with the pipe.

9. The machine of claim 5 wherein:

said actuating member is formed having a plurality of rounded depressions and camming surfaces;

each of said jaws has a roller mounted therewith; whereupon each of said jaws is retracted when each roller is disposed in one of said rounded depressions and each of said jaws is actuated to move toward the pipe when relative rotation between said actuating member and said drag ring results in radial displacement of each of said jaws as each of said rollers is displaced out of one of said rounded depressions and moves along one of said camming surfaces.

10. The machine of claim 5, wherein:

each of said jaws is connected to said drag ring by a pivot pin mounted therewith;

a plurality of links, one of which is pivotally mounted to each of said jaws to said drag ring;

said actuator member having a plurality of gear teeth;

each of said links having a plurality of gear teeth meshing with said gear teeth on said actuating member;

whereby, upon relative rotation between said actuating member and said drag ring, each of said links pivots about its pivot pin so that each of said jaws is moved toward or away from the pipe.

11. A machine for applying or resisting a turning force to a pipe comprising:

a frame;

an actuating member mounted to said frame;

drive means mounted to said frame for selective movement of said actuating member;

a drag ring supported by said frame;

a plurality of jaws movably mounted to said drag ring and operably connected to said actuating member;

means mounting said actuating member for permitting relative movement of said actuating member with respect to said drag ring to cause said jaws to move toward the pipe;

each jaw further comprising:

a pair of gripping pads mounted to each of the jaws, each of said gripping pads having a gripping face formed to substantially conform to the outside diameter of the pipe to be torqued;

each of said jaws having a plurality of recesses, each recess having a recess wall and adapted to receive one of said gripping pads;

an elastically deformable elastomer insert means disposed within and filling each of said recesses inwardly of each of said gripping pads for providing a substantially even distribution of forces, equivalent to force distribution in a confined hydraulic medium, along the entire length of each of said gripping pads upon an uneven force being applied on each of said gripping pads when there is contact between said gripping pads and the pipe;

whereupon the pressure applied by each of said gripping pads is resultantly substantially uniform over said outer gripping face of each of said gripping pad;

each of said jaws connected by a pivot pin mounted therewith;

a plurality of links, one of which is pivotally mounted to each of said jaws and to said drag ring;

said actuator member having a plurality of gear teeth;

each of said links having a plurality of gear teeth meshing with said gear teeth on said actuating member;

whereby, upon relative rotation between said actuating member and said drag ring, each of said links pivots about its pivot pin so that each of said jaws is moved toward or away from the pipe;

means to retard the pivotal movement of each of said jaws relative to the corresponding one of said links to which it is pivotally mounted;

each of said jaws having a reversing shoulder disposed substantially between said gripping pads and said pivotal mounting between each of said links and each of said jaws;

said drag ring further having a plurality of reversing pins, each of which is disposed to engage one of said reversing shoulders on one of said jaws upon actuation of said actuating member in the absence of a pipe, to reorient each of said jaws thereby allowing each of said plurality of said gripping pads to engage a pipe from an alternate position to allow the machine to apply or resist turning forces in either a clockwise or counterclockwise direction.

12. The machine of claim 11 wherein:

said pivotal mounting connection between each of said jaws and each of said links is a clearance fit; and each of said links has a shoulder thereon whereby upon contact between a pipe and each of said plurality of gripping pads, load is transferred from the gripping pads to the shoulder on one of said links to minimize the applied stress on said pivotal mounting between each of said jaws and each of said links.

* * * * *